United States Patent [19]

Canfield

[11] Patent Number: 5,018,227

[45] Date of Patent: May 28, 1991

[54] PORTABLE INSULATED TENT—COT

[76] Inventor: Michael A. Canfield, 10418 N. 48th Pl., Phoenix, Ariz. 85028

[21] Appl. No.: 439,875

[22] Filed: Nov. 21, 1989

[51] Int. Cl.[5] ..... A47C 17/64

[52] U.S. Cl. ..... 5/113; 5/111; 5/187

[58] Field of Search ..... 5/111-114, 5/121, 187, 414, 421, 420, 449; 135/96; 224/153, 154, 156

[56] References Cited

U.S. PATENT DOCUMENTS

| | | | |
|---|---|---|---|
| 947,472 | 1/1910 | Lehman | 5/113 |
| 2,639,442 | 5/1953 | Herzog | 5/112 |
| 3,601,825 | 8/1971 | Moorhead | 5/113 X |
| 4,012,800 | 3/1977 | Mitchell et al. | 5/187 |
| 4,658,482 | 4/1987 | Brockhaus | 5/455 X |
| 4,872,470 | 10/1989 | Hayashida et al. | 135/97 |
| 4,914,768 | 4/1990 | Howard | 5/113 |

FOREIGN PATENT DOCUMENTS

| | | | |
|---|---|---|---|
| 14765 | of 1895 | United Kingdom | 5/114 |
| 1091667 | 11/1967 | United Kingdom | 5/113 |

*Primary Examiner*—Michael F. Trettel
*Attorney, Agent, or Firm*—Tod R. Nissle

[57] ABSTRACT

A cot-tent which insulates against the loss of heat by convection, conduction, and radiation and which is unusually simple to manufacture, use and store.

10 Claims, 4 Drawing Sheets

PORTABLE INSULATED TENT—COT

This invention relates to bedding.

More particularly, the invention relates to a cot--tent which insulates against the loss of heat by convection, conduction and radiation and which is unusually simple to manufacture, use and store.

In another respect, the invention relates to a cot which can be manufactured without sewing material onto the structural components comprising the cot frame.

Cots and cot--tent structures have existed for many years. Particular disadvantages associated with existing cot--tent structures are that the structures are labor intensive in manufacture and in use require the manipulation of a number of moving parts which make it awkward to assemble, disassemble and transport the cot--tent.

In particular, during the manufacture of a conventional cot, fabric often is stretched under tension between spaced apart frame members, is wrapped around each frame member and back against itself, and is then stitched together. This stitching procedure is awkward because it requires that the fabric be manufactured under tension and that the head of a sewing machine extend over a frame member so that the sewing machine needle can complete a stitch on the "inside" of the frame member. Another disadvantage of existing cots and tents is that they ordinarily do not effectively prevent the transfer of heat from an individual's body through the cot or tent.

Accordingly, it would be highly desirable to provide an improved cot--tent which would not require the tension stitching of material onto the cot frame and which would effectively prevent the transfer of heat through the pliable fabric material comprising the tent or cot.

Therefore, it is a principal object of the invention to provide improved bedding.

Another object of the invention is to provide an improved tent--cot which can be manufactured without requiring that fabric be stitched in place on the frame of the tent--cot.

A further object of the invention is to provide an improved cot which provides insulation against the transfer of heat through a wall of the tent--cot by convection, conduction or radiation.

These and other, further and more specific objects and advantages of the invention will be apparent to those skilled in the art from the following detailed description thereof, taken in conjunction with the drawings, in which.

Figure 1:
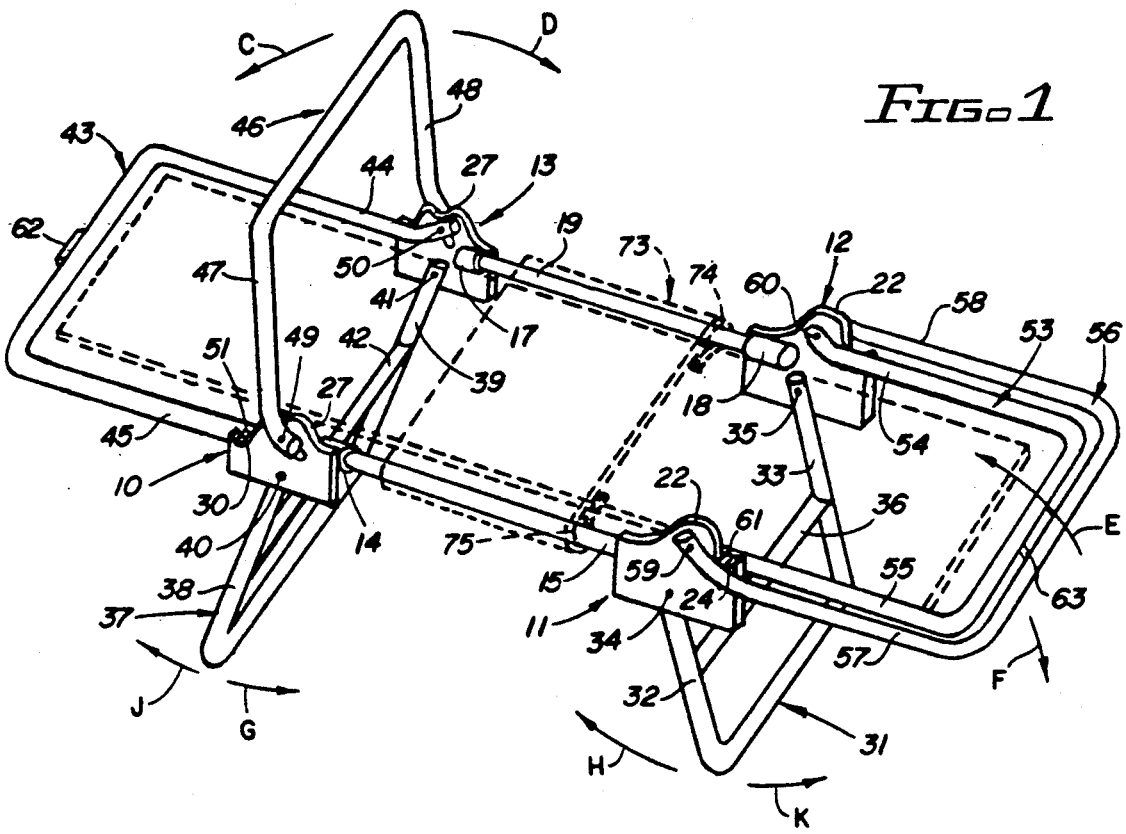
FIG. 1 is a perspective view illustrating the frame of a cot--tent constructed in accordance with the principles of the invention.

Briefly, in accordance with my invention, I provide an improved bed. The bed includes bedding means defining a surface for an individual to recline on and including a layer of pliable material; means for supporting the bedding means above and spaced apart from the ground; and, a pliable thermal layer adjacent the bedding material. The thermal layer insulates against the transfer of heat by convection, radiation and conduction through the layer of bedding material.

In an alternate embodiment of my invention I provide an improved bed including bedding means defining a surface for an individual to recline on; pliable tent means at least partially covering the bedding means; frame means for supporting the bedding means above the ground and including a pair of spaced apart legs each having a first and second end, an upright tent support having a first end and a second end and supporting a portion of the tent means above and spaced apart from the bedding means, and an outrigger member having first and second ends. The first end of each of one of the legs, of the upright tent support and of the outrigger member are pivotally attached to the first hinge member. The second end of each of said one of the legs, of the tent support and of the outrigger member are pivotally attached to the second hinge member. The support means can include a central support structure; a pair of legs each connected to and extending outwardly away from the central support structure; and, at least one outrigger structure connected to and extending outwardly from the central structure, the outrigger structure at least partially circumscribing and bounding an open area. The bedding means can include a pliable fabric pocket shaped and dimensioned to slide over the outrigger structure to extend across the open area to support the weight of at least a portion of the individual's body which is bearing against the pocket. The central support structure can include a pair of opposed spaced-apart elongate members bounding a space intermediate the elongate members; and, a pliable fabric member connected to the elongate members and extending across the space intermediate the elongate members to support the weight of at least a portion of the individual's body bearing against the fabric member. The bed can include a tent support member pivotally connected to the frame means and normally extending upwardly and outwardly from the bedding means and shaped and dimensioned to be foldable to nest in the outrigger structure. The bed can include a pliable fabric tent structure extending in part over the tent support member above at least a portion of the bedding means and sized and connected to the bed such that the tent support member is prevented from being folded to nest in the outrigger structure by a portion of the fabric tent structure, the tent structure portion contacting the tent support member to maintain the tent support member in an upright orientation by offsetting the force of gravity acting on the tent support member.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates the frame of a foldable portable tent--cot constructed in accordance with the principles of the invention and including hinge members 10, 11, 12, 13. Hinge member 10 is identical to hinge member 13. Hinge member 11 is identical to member 12. Hollow sleeve member 14 is attached to the inner face of hinge member 10. An identical hollow sleeve member 16 (not visible) is attached to the inner face of hinge member 11. The ends of the central tubular strut 15 are slidably received by and fastened with adhesive or other means to sleeve member 14 and to sleeve member 16 on the inner surface of member 11. Hollow sleeve member 17 is attached to the inner face of hinge member 13. Hollow sleeve member 18 is attached to the inner face of hinge member 12. The ends of the central tubular strut 19 are slidably received by and secured with adhesive or other means to sleeve members 18, 19.

Figure 7:
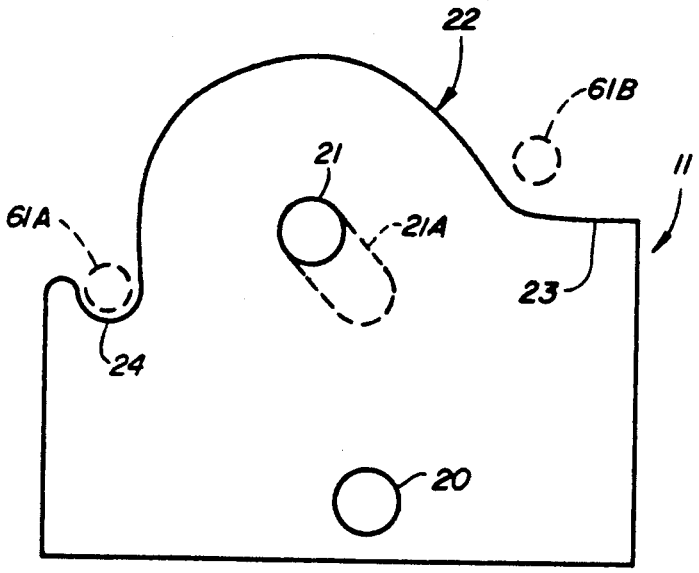
FIG. 7 is a side view illustrating a hinge in the frame of FIG. 1.
Figure 8:
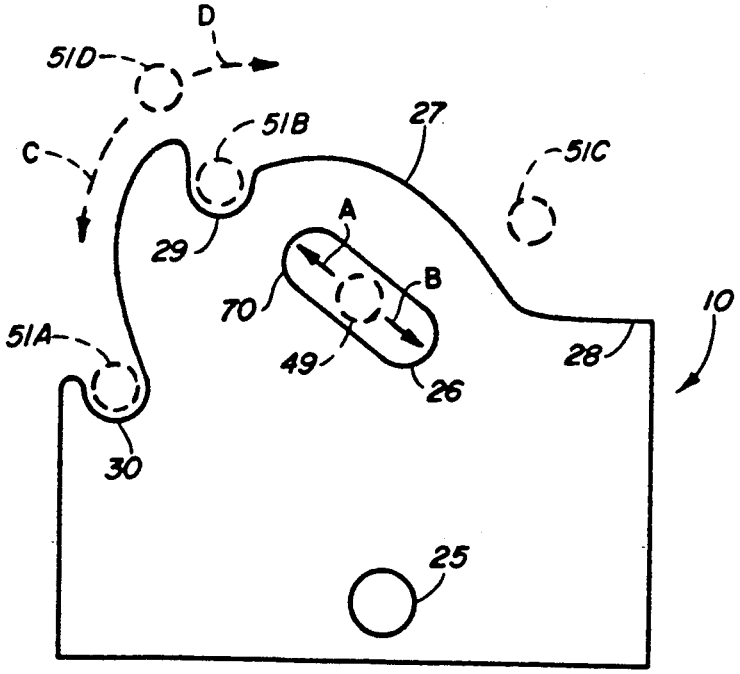
FIG. 8 is a side view illustrating another hinge in the frame of FIG. 1.

Hinge members 10, 11, 12, 13 are presently preferably stamped, die cut, or otherwise cut or removed from sheet stock. Hinge 11 (and consequently hinge 12) includes circular apertures 20 and 21 formed therethrough (FIG. 7). Upper cam surface 22 includes a flat area 23 and a semicircular detent or notch 24. Hinge 10 (and consequently hinge 13) includes circular aperture 25 and elongate slot 26 formed therethrough (FIG. 8). Upper cam surface 27 includes flat area 28, semicircular notch or detent 29 and semicircular notch or detent 30.

Since hinge member 12 is identical to hinge member 11, hinge member 12 also includes the apertures 20 and 21, the cam surface 22, the flat area 23, and the detent 24 illustrated in FIG. 7.

Since hinge member 13 is identical to hinge member 10, hinge member 13 also includes the circular aperture 25, the elongate slot 26, the cam surface 27, the flat area 28, the semicircular detent 29 and the notch 30 illustrated in FIG. 8.

In FIG. 1, U-shaped leg 31 includes a first end 32 and a second end 33. Pin 34 is straight and passes through aperture 20 of member 11 and end 32 to pivotally connect end 32 to hinge member 11. Pin 25 is straight and passes through end 33 and aperture 20 of hinge member 12 to pivotally connect end 33 to hinge member 12. Cross brace 36 is connected to leg 31.

U-shaped leg 37 includes a first end 38 and a second end 39. Pin 40 is straight and passes through aperture 25 of member 10 and through end 38 to pivotally connect end 38 to hinge member 10. Pin 41 is straight and passes through end 39 and aperture 20 of hinge member 13 to pivotally connect end 39 to hinge member 12. Cross brace 42 is connected to leg 37.

Outrigger member 43 includes first end 45 and second end 44. Tent support member 46 includes first end 47 and second end 48. Pin 49 is straight and passes through end 47, slot 26 of member 10 and end 45 to pivotally connect ends 47 and 45 to hinge member 10. Pin 50 is straight and passes through end 44, slot 26 of member 13 and end 48 to pivotally connect ends 44 and 48 to member 13. Pin 49 can slide along slot 26 of member 10 in the directions indicated by arrows A and B in FIG. 8. Pin 50 can similarly slide along slot 26 of member 13 in the directions indicated by arrows A and B. Member 46 can be pivoted independently of member 43 about pins 49 and 50 in the directions of arrows C and D in FIG. 1. Member 43 can be pivoted independently of member 46 about pins 49 and 50 in the directions of arrows C and D. When pins 49 and 50 slide along slots 26 in the direction of arrows A and B, ends 47, 48, 44, 45 also move simultaneously with pins 49 and 50 in the direction of arrows A and B.

Outrigger member 53 includes first end 55 and second end 54. Tent support member 56 includes first end 57 and second end 58. Pin 59 is straight and passes through end 57, aperture 21 of member 11 and end 55 to pivotally connect ends 55 and 57 to hinge member 11. Pin 60 is straight and passes through end 54, aperture 21 of member 12, and end 58 to pivotally connect ends 54 and 58 to member 12. Member 56 can be pivoted independently of member 53 about pins 59 and 60 in the direction of arrow E in FIG. 1. Member 53 can be pivoted independently of member 56 about pins 59 and 60 in the direction of arrow E After being pivoted in the direction of arrow E, members 53 and 56 can be pivoted about pins 59 and 60 in a direction opposite that of arrow E to return members 53 and 56 to the position illustrated in FIG. 1. Members 53 and 56 are shaped and dimensioned such that member 53 fits within or nests in member 56 both when member 56 is in the position shown in FIG. 1 and when members 53 and 56 are in the folded configuration shown in FIG. 6. Similarly, members 43 and 46 are shaped and dimensioned such that member 43 can nest in member 46, both when members 43 and 46 are in the folded configuration shown in FIG. 6 and when member 43 is in the position shown in FIG. 1. If, in FIG. 1, member 46 is pivoted in the direction of arrow C to a position adjacent to the position of member 43 in FIG. 1, then member 43 is nested inside member 46.

In FIG. 1, pin 51 is fixedly attached to and outwardly extends from end 45. Pin 51 is nested in detent 30. A similar pin 51 (not visible) is attached to and extends outwardly from end 44 and is nested in detent 30 of member 13. Pin 61 is fixedly attached to and outwardly extends from end 55. Pin 61 is nested in detent 24. A similar pin 61 (not visible) is fixedly attached to and extends outwardly from end 54 and is nested in detent 24 of member 12. When member 43 is pivoted in the directions indicated by arrow C and D, pins 51 ordinarily will not, unless nested in detent 30, contact cam surfaces 27. Similarly, when member 53 is pivoted in the direction of arrow E or in a direction opposite arrow E, pins 61 ordinarily will not contact cam surfaces 22 unless pins 61 are nested in detents 24. If desired, cam surfaces 22 and 27 can be shaped and dimensioned such that pins 51 and 61 slide along at least a portion of the surfaces while members 43 and 53 are being pivoted to move pins 51 and 61 to and from detents 24, 29, and 30.

In FIG. 1, tab 63 is connected to and outwardly extends from member 53. Tab 63 is sized such that it contacts member 56 and prevents member 56 from moving past member 53 in the direction of arrow F. Similarly, tab 62 is connected to and outwardly extends from member 43. Tab 62 is sized such that if in FIG. 1 member 46 is, while member 42 is maintained stationary, pivoted about hinges 10, 13 in the direction of arrow C, member 46 will contact tab 62 and tab 62 will then prevent member 46 from moving downwardly past member 43 in the direction of arrow C.

Figure 2:
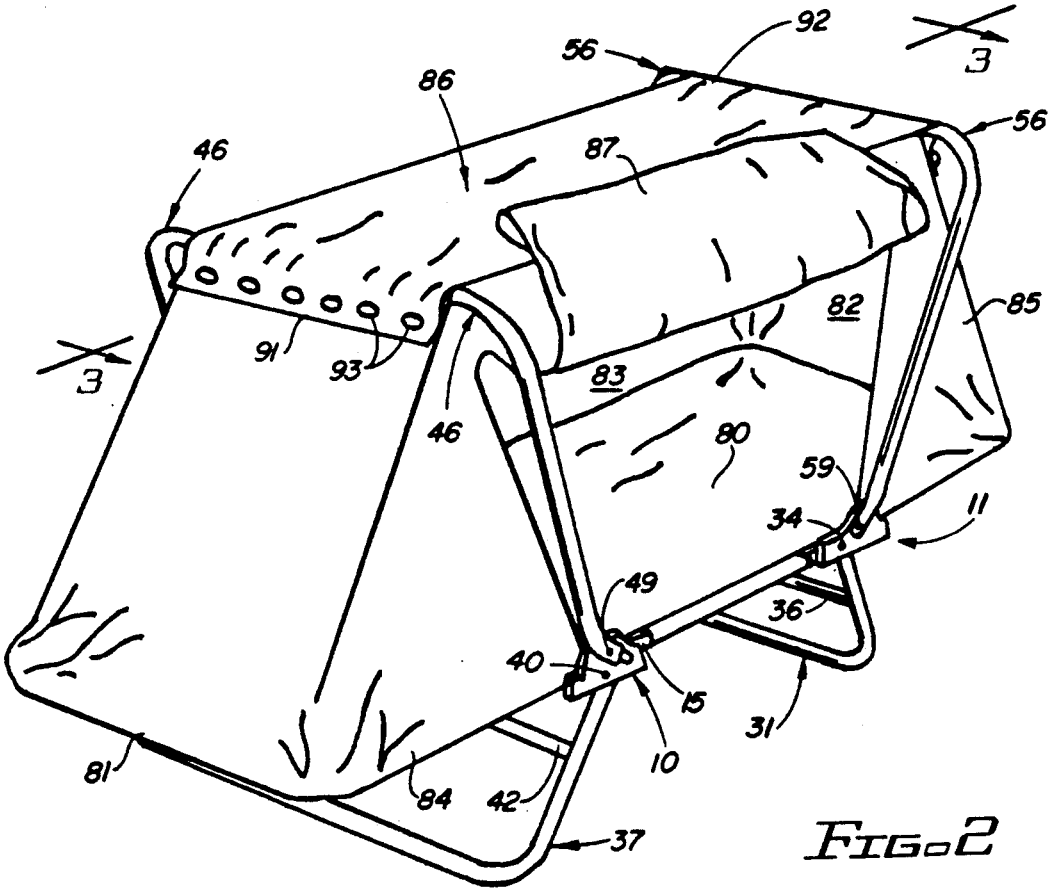
FIG. 2 is a perspective view illustrating the frame of FIG. 1 after pliable fabric material defining the walls of the tent and floor of the cot have been mounted on the frame.
Figure 6:
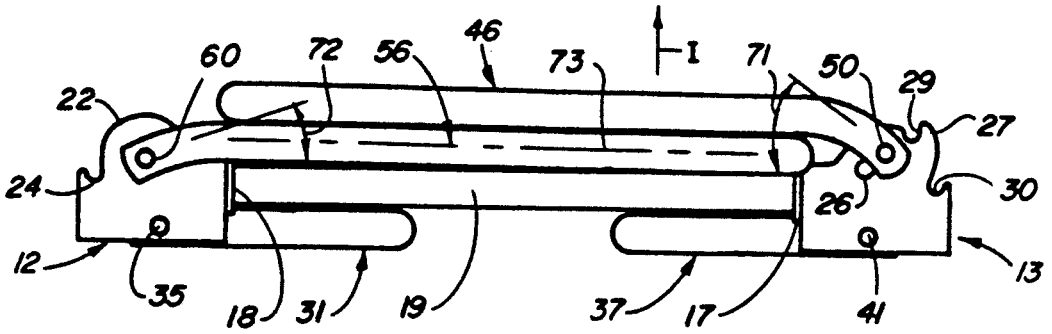
FIG. 6 is a side view illustrating the frame of FIG. 1 after the frame has been folded for storage.

The various positions of member 43, 46, 53, 56 are further explained with reference to FIGS. 1, 2, 6 to 8. The bed of FIG. 1 is folded to the storage configuration by pivoting legs 37 and 31 in the direction of arrows G and H, respectively; by pivoting members 43 and 46 in the direction of arrow D; and, by pivoting members 53 and 56 in the direction of arrow E. The folded storage configuration is illustrated in FIG. 6. When the bed is in the storage configuration, pin 61 on end 55 is in the position illustrated by dashed lines 61B in FIG. 7 and pin 51 on end 45 is in the position illustrated by dashed lines 51C in FIG. 8. When the fabric tent structure, which is described below in further detail, is mounted on the frame of FIG. 1, the bed of the invention has the appearance shown in FIG. 2. The orientation of the frame members in FIG. 2 is identical to the orientation of the frame members in FIG. 1, except that in FIG. 2 member 56 is pivoted upwardly in the direction of arrow E form the position of member 56 shown in FIG. 1. When members 53, 56, 43, 46, 31, 37 are in the orientation of FIG. 2, pin 61 on end 55 is in the position illustrated by dashed line 61A in FIG. 7 and pin 51 on end 45 in the position illustrated by dashed lines 51A in FIG. 8.

The frame of FIG. 1 can be configured to be utilized as a lounge chair by moving member 43 upwardly in the direction of arrow D from the position illustrated in FIG. 1. When this upward movement is being carried out, member 43 is moved in the direction of arrow D until it is adjacent with member 46 in FIG. 1, i.e., member 43 is moved in the direction of arrow D until is it partially upright. When member 43 is in this partially upright position, pins 49 are positioned in slots 26 in a location corresponding to the farthest possible point of travel of the pins in the direction of arrow A in slot 26. In other words, pins 49 are positioned in the upper ends 70 of slots 26. Members 43 and 46 are then pushed downwardly in the direction of arrow B. This causes pins 49 to slide along slots 26 in the direction of arrow B until pins 49 are at the bottom of slots 26. When pins 49 are at the bottom of slots 26, pins 51 are seated in detents 29 and pins 51 are each in the position indicated by dashed lines 51B in FIG. 8. Members 43 and 46 are in the lounge chair configuration. Members 43 and 46 can be removed from the lounge chair configuration by pulling members 43 and 46 in the direction of arrow A. When members 43 and 46 are pulled in the direction of arrow A, pins 49 slide upwardly along slots 26 in the direction of arrow A until pins 49 contact the upper ends 70 of slots 26. When pins 49 are at the upper ends 70 of slots 26, pins 51 are each in the position indicated by dashed lines 51D in FIG. 8. When pins 51 are in the position indicated by dashed lines 51D, then members 43 and 46 can be rotated in the directions indicated by arrows C and D.

The angle 71 in FIG. 6 is greater than the angle 72. This means that the distal end of member 56 connected to pin 60 is bent less from the longitudinal axis 73 than is the distal end of member 46 connected to pin 50. The more significant bend in the distal end of member 46 enables member 46 to extend up and over member 56 in the manner shown in FIG. 6 so that member 46, member 56, member 19, and legs 31 and 37 are parallel to one another when the frame of FIG. 1 is folded. Slot 26 also facilitates the ability of member 46 to move or slide upwardly in the direction of arrow I so that member 46 can be positioned parallel to member 56. The degree of bend of the distal end of member 46 attached to pin 49 is equivalent to the amount of bend in the distal end of member 46 attached to pin 50. The amount of bend of the distal end of member 56 attached to pin 59 is equivalent to the amount of bend in the distal end of the member 56 attached to pin 60. To facilitate the compact folding of members 53 and 56, a slot 21A can be formed in each member 11 and 12 in place of aperture 21.

The frame of FIG. 1 is assembled without requiring that fabric be stitched onto the frame members before, during or after assembly. The fabric support member 73 illustrated in FIG. 1 is manufactured or stitched together in the configuration shown in FIG. 1 with an open loop or sleeve 74, 75 at each end of the fabric member 73. During assembly of the frame, strut 19 is slid through loop 74. Strut 15 is slid through loop or sleeve 75. The ends of struts 19 and 15 are then affixed to sleeve pairs 17, 18 and 14, 16, respectively. The fabric cot--tent structure shown in FIG. 2 is removably installed on the frame of FIG. 1.

Although omitted from the drawings for the sake of clarity, the ends 32, 33, 38 and 39 of legs 31 and 37 are shaped and dimensioned such that when legs 31 and 37 are in the position illustrated in FIG. 1, ends 32, 33, 38, 39 contact sleeves 16, 18, 14, 17, respectively, and legs 31 and 37 are prevented by sleeves 16, 18, 15, 17 from rotating or pivoting any further in the directions indicated by arrows K and J, respectively.

Figure 3:
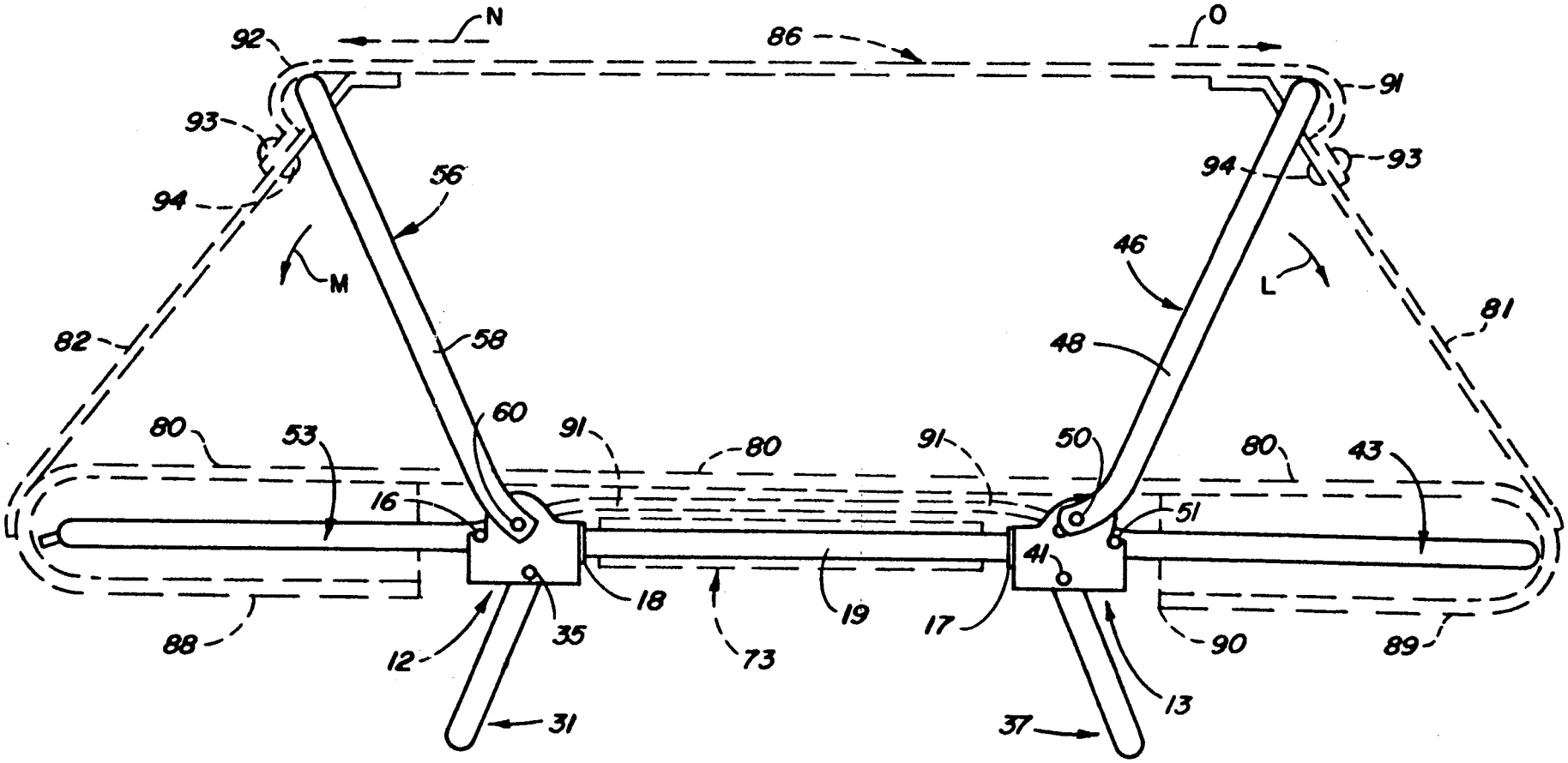
FIG. 3 is a side view of the cot--tent of FIG. 2 further illustrating in ghost outline the mounting of fabric material on the cot frame where the fabric material in FIG. 3 is seen along section line 3—3 in FIG. 2.
Figure 4:
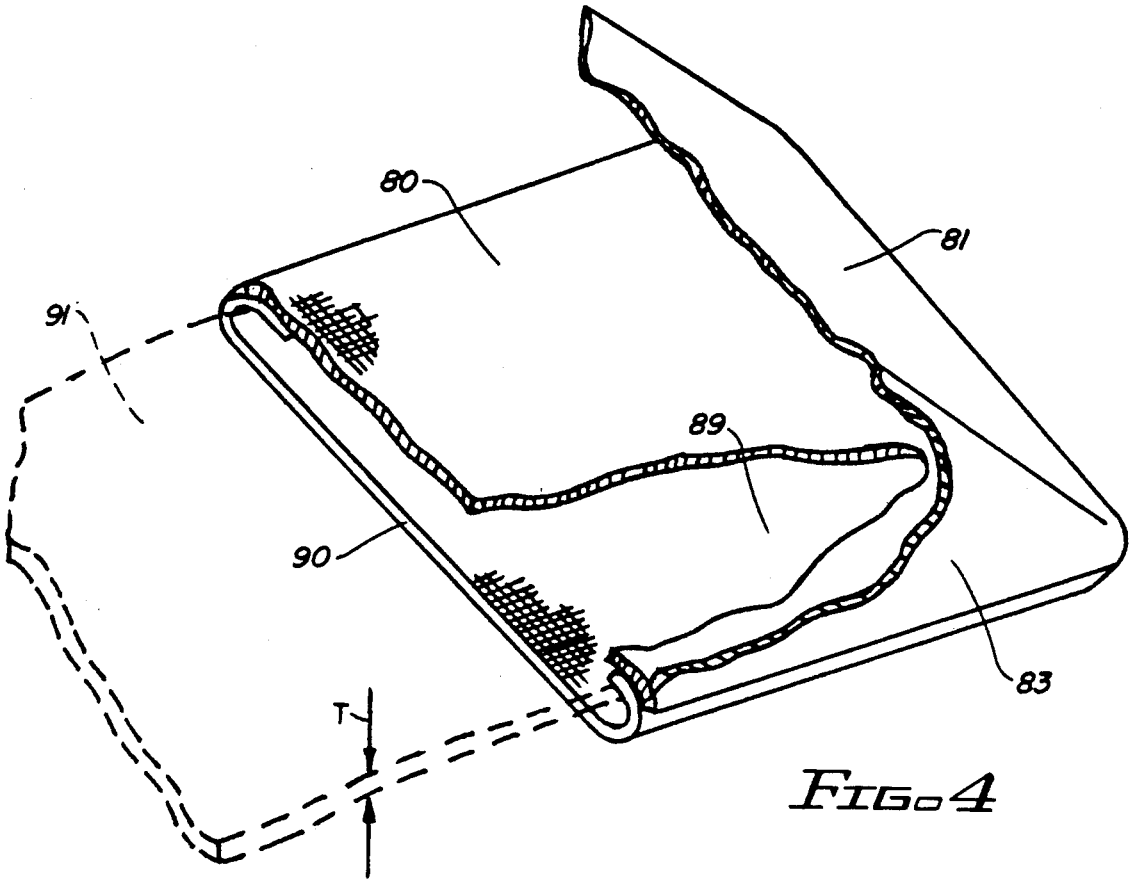
FIG. 4 is a perspective view of a portion of the fabric material of FIG. 2 illustrating further construction details thereof.

The fabric tent structure carried on the frame of FIG. 1 is illustrated in FIGS. 2, 3 and 4. FIG. 3 is a rear view of the cot--tent of FIG. 2 with the fabric tent structure being shown in a ghost outline taken along section line 3—3 in FIG. 2.

The fabric tent structure includes a rectangular pliable fabric floor panel 80; end panels 81 and 82 (sloped in FIG. 2); back panel 83; front side panel 84; front side panel 85; roof panel 86; door panel 87; and sub--floor panels 88 and 89. Panels 80 to 89 are sewn together or otherwise integrally formed or interconnected to form a unitary fabric tent structure mountable on the frame of FIG. 1. Each sub--floor panel 88 and 89 is attached to floor panel 80 to form a pocket which slidably fits over either member 43 or member 53. For example, in FIG. 4 sub--floor panel 89 is shown attached to panel 80 to form a pocket. The pocket slides over member 43 in the manner illustrated in FIG. 3. Leading edge 90 of sub-floor panel 89 defines, in part, the mouth of the pocket formed between 89 and panel 80. Roof panel 86 includes ends 91 and 92 which extend over the upper portions of members 46 and 56, respectively. Each end 91 and 92 includes a plurality of male snap members. A plurality of opposing female snap members 94 is mounted in end panels 81 and 82. The fabric tent structure of FIGS. 2 and 3 is removably secured to members 46 and 56 by extending ends 91 and 92 over members 46 and 56 in the manner shown in FIG. 3 and then snapping together opposing male 93 and female 94 members. In FIG. 3, the force of gravity acts on members 46 and 56 and tends, along with the weight of the fabric tent structure bearing down against members 46 and 56, to pull members 46 and 56 in the direction of arrows L and M, respectively. When the force of gravity and other forces pull members 46 and 56 in the direction of arrows L and M, roof panel is pulled and tensioned in the direction of arrows O and N. Since roof panel 86 is not elastic, or is elastic but only stretches a selected amount under the forces pulling members 46 and 56 in the direction of arrows L and M, once panel 86 is tensioned it maintains members 46 and 56 in the upright orientation shown in FIG. 3.

The fabric tent structure of FIGS. 2 and 3 is installed on the frame of FIG. 1 by pivoting members 43 and 53 to a generally upright orientation, i.e., by pivoting members 43 and 53 to an orientation similar to that of member 46 in FIG. 1. The pockets formed by sub--floor panels 88 and 89 and floor panel 80 are then slid over members 43 and 53 such that the fabric tent structure and panel 80 pass through and under members 46 and 56 and such that panel 80 is above panels 88 and 89. Members 43 and 53 are then pivoted in the direction of arrows C and F, respectively, in FIG. 1 until members 43 and 53 are in the orientation shown in FIGS. 1, 2, and 3. When members 43 and 53 are in the orientation of FIG. 3, floor member 80 is tensioned and flattened. Member 46 is, while members 43 and 53 remain in the positions shown in FIG. 3, pivoted to the upright position of FIG. 1. End 91 is pulled over member 46 in the manner shown in FIG. 2 and the male snap members 93 are connected to the female snap members in panel 81. Member 56 is then moved to an upright orientation generally corresponding to the orientation shown in FIG. 8 and end 92 is pulled over the upper portion of member 56 in the manner shown in FIGS. 2 and 3 and the male snap members 93 in end 92 are attached to the female snap members in end panel 82. After the door panel 87 is rolled onto the roof panel 86, the fabric tent structure is mounted on the frame in the manner shown in FIG. 2. The cot--tent of FIG. 2 is readily converted to a simple cot by disconnecting all snap members 93 from opposing members 94 and allowing panels 81, 82, 83, 84, 85, and 86 to fall onto floor panel 80. After members 46 and 56 are lowered to horizontal positions similar to that of member 56 in FIG. 1, the cot--tent of FIG. 2 provides a horizontal support surface and can be utilized as a cot. Once the cot--tent of FIG. 2 is partially disassembled in the manner just described to serve as a cot, it can be adapted to serve as a lounge chair by raising member 43 to an upright position in which pins 51 are, as earlier described, seated in detents 29 of members 10 and 13.

Figure 5:
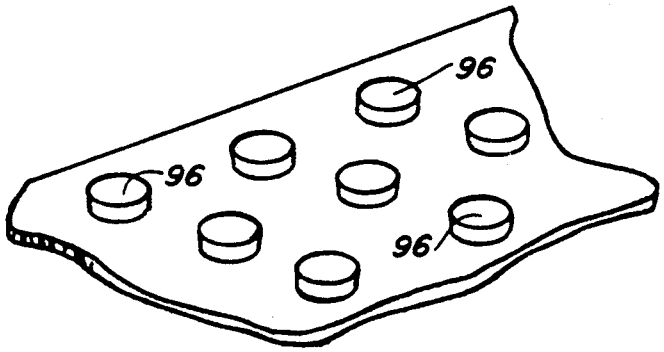
FIG. 5 is a perspective view illustrating a portion of a sheet of bubble plastic material including bubbles which define and bound dead air spaces which insulate against the transfer of heat by convection and conduction.

In FIG. 3, a rectangular thermal insulation pad or laminate is shown by dashed lines 91. Pad 91 extends intermediate floor panel 80 and member 73 and also extends laterally into the pocket formed by sub--floor panel 88 and panel 80 and into the pocket formed by sub--floor panel 89 and panel 80. Consequently, the rectangular heat insulation pad has a length and width which is slightly smaller than the length and width of floor panel 80. Pad 91 is adjacent and generally contacts panel 80. Pad 91 preferably includes a central layer of a bubble polyethylene sheet sandwiched between two sheets of aluminum foil. The bubble plastic sheet in FIG. 5 includes a plurality of hollow plastic cylinder or bubbles 96 which each encapsulate a dead air space. Bubbles 96 can be spaced apart in the manner illustrated in FIG. 5 or can be adjacent and contacting one another. The dead air spaces encapsulated by bubbles 96 insulate against the transmission of heat by convection and conduction. The layers of aluminum foil covering the upper and lower surfaces of the bubble plastic sheet insulate against the loss of heat by reflecting infrared and other types of radiation. Pockets can be formed on the inner or outer surfaces of panels 81, 82, 83, 84, 85, 86 to receive and position a thermal insulation pad 91 against the panels to insulate the panels 81 to 86 against the transfer of heat therethrough. Any desired means can be utilized to position thermal insulation panels or materials against panels 81 to 86 or against floor 80. In FIG. 4, thermal insulation pad 91 is illustrated in dashed lines extending into the pocket formed intermediate sub--floor panel 89 and panel 80.

The pliable fabric material utilized in manufacturing the pliable tent structure can be comprised of woven natural or synthetic fibers, can be comprised of pliable sheets of plastic or rubber, or can be made of any other pliable material which can be mounted on the frame of FIG. 1. The pliable material utilized to manufacture the pliable fabric tent structure preferably is not bulky so that the frame of FIG. 1 can readily be folded to the storage configuration of FIG. 6 while the tent structure is still mounted on the frame. As utilized herein and in the claims, the term fabric encompasses woven materials made from natural or synthetic fibers, and encompasses pliable sheets of plastic, rubber, composites, etc.

The thermal insulation pad 91 has a number of special properties which facilitate the use of pad 91 in the invention. Pad 91 is lightweight and has a density of less than fifteen pounds per cubic foot, preferably less than five pounds per cubic foot. The aluminum foil--plastic bubble--aluminum foil laminate earlier described has a density of approximately one to two pounds per cubic foot. Aluminum foil--fiber glass--aluminum foil insulation bat can be fabricated which has a density of about one pound per cubic foot, where the density is calculated using the 11-12 ILD density formula. It should be understood that when the density of pad 91 is being determined, a piece of material having the thickness of the pad is evaluated. The layers of the pad must be evaluated as a whole. Consequently, when a section of the aluminum foil--bubble plastic pad described earlier is evaluated for density, the section has the normal thickness of the pad and includes both layers of aluminum foil and the bubble plastic sandwiched in between the layers of aluminum foil. The light weight of pad 91 greatly facilitates use of the bed of the invention.

The thickness, indicated by arrows T in FIG. 4, of thermal pad 91 is five inches or less, preferably two inches or less. A two inch or less thickness is preferred because it facilitates folding of the bed of FIG. 2 and contributes to the light weight of the bed.

The R value or insulative value of the pad 19 can be any desired value. The aluminum foil--plastic bubble--aluminum foil laminate pad presently utilized has an R value of about 13.

Pad 91 is preferably pliable and foldable. The pliable and foldable nature of pad 91 is critical in the use of the tent--cot of FIG. 2, both in the folding and storage of the tent--cot and in the use of the cot to sleep on. The tent--cot of FIG. 2 functions like a hammock. The only cross brace members in the frame (FIG. 1) of the cot which are beneath panel 80 are members 42 and 36. Fabric member 73, sub--floor panels 88 and 89, and floor panel 80 do not contact members 42 and 36 when an individual reclines on panel 80. The only frame members supporting member 73 and the pockets formed by panels 80, 88 and 89 are the frame members 43, 53, 15 and 19. The hammock-like functioning of pliable member 73 and the pockets formed by panels 80, 88 and 89 is important because when an individual reclines on panel 80, pliable panel 80 conforms and contours to portions of the individual's body contacting and/or bearing against panel 80. Member 73 and panels 88 and 89 also tend to contour to portions of the individual's body bearing through panel 80 against member 43 and panels 88 and 89.

In the presently preferred embodiment of the invention, panel 80 is approximately 6.5 feet long by 2.5 feet wide. Panel 86 is approximately 4.0 feet long by 2.5 feet wide. In FIG. 2, the shortest distance from panel 80 to panel 86 is about two feet. Consequently, the approximate volume of the inner space which is inside the fabric tent structure in FIG. 2 and is bounded by panels 80, 81, 82, 83, 84, 85, 86, and 87 (when the door panel is down or in the closed position) is about 32 cubic feet. The volume of the inner space of the fabric tent structure is an important factor in the use of the tent--cot of the invention to protect an individual against inclement weather. The human body has the capacity to heat or cool a relatively small restricted area. When the area becomes too large, the human body cannot effectively heat or cool the air. The volume of the inner space in the tent--cot of the invention should be equal to or less than 150 cubic feet (i.e., be equivalent to a space which is five feet by five feet by six feet) per person in the tent--cot, and preferably should be equal to or less than fifty cubic feet per person housed in the tent--cot. Accordingly, if the tent--cot is constructed to house two individuals, the volume of the space inside the tent--cot preferably should be equal to or less than one hundred cubic feet; should be equal to or less than 150 cubic feet if the tent is sized to house three individuals; etc.

Factors which importantly contribute to the effectiveness of the tent--cot of the invention in providing a comfortable, insulated bed are the spacing of panel 80 and pad 91 off of the ground; the use of low density insulation having a density of less than five pounds per cubic foot; the use of pliable insulation; the use of insulation, when desired, on the wall of a tent which incloses an area having no more than fifty cubic feet per person in the tent; and, the use of insulation having a thickness equal to or less than two inches.

Having described my invention in such terms as to enable those skilled in the art to understand and practise it, and having identified the presently preferred embodiments thereof, I claim:

1. A bed including (a) bedding means defining a surface for an individual to recline on;

(b) pliable tent means at least partially covering said bedding means;

(c) frame means for supporting said bedding means and tent means above the ground and including (i) first and second spaced apart legs, each of said legs having an upper end and a lower ground contacting end, (ii) a U-shaped upright tent support having a first and second lower ends and supporting a portion of said tent means above and spaced apart from said bedding means, (iii) a U-shaped outrigger member having first and second bottom ends, (iv) a first unitary hinge member connected to one of said upper ends and having a first vertically oriented slot extending through said hinge member, a first pin slidably carried in said slot for vertical displacement along said slot between first and second operative positions, said pin extending through and outwardly from said hinge member and connected to one of said lower ends, and one of said bottom ends, such that said tent support and said outrigger member are interconnected by said pin, said outrigger member can be pivoted with respect to said first hinge member simultaneously with or independently of said tent support, and when said pin is moved from said first to said second operative position, said one of said lower ends and said one of said bottom ends are simultaneously vertically displaced with said pin, (v) a second unitary hinge member spaced apart from said first unitary hinge member and connected to the other of said upper ends and including a second vertically oriented slot extending through said hinge member, a second pin slidably carried in said slot for vertical displacement along said slot between first and second operative positions, said pin extending through and outwardly from said hinge member and connected to the other of said lower ends, and the other of said bottom ends, such that said tent support and said outrigger member are interconnected by said second pin, said outrigger member can be pivoted with respect to said second hinge member simultaneously with or independently of said tent support, and when said pin is moved from said first to said second operative position, said other of said lower ends and said other of said bottom ends are simultaneously vertically displaced with said pin.

2. The bed of claim 1 wherein one of the pair comprising said outrigger member and said tent support is shaped and dimensioned to fit inside the other of said pair.

3. The bed of claim 1 wherein (a) said tent support includes a control pin attached to and outwardly extending from said one of said bottom ends;

(b) said first hinge member includes a cam control surface interconnecting (i) a first detent, and (ii) a second detent and (c) said outrigger member moves between (i) a first horizontally oriented position with said control pin seated in said first detent and said first pin in said first operative position in said first slot, and (ii) a second position with said outrigger member pivoted about said first slot and upwardly displaced from said first operative position to move said control pin from said first detent over said control surface to seat in said second detent, and, said first pin vertically displaced in said slot from said first operative position to said second operative position, said outrigger member functioning as the back of a chair in said second operative position.

4. A bed including (a) bedding means defining a surface for an individual to recline on and including a layer of pliable material, (b) means for supporting said bedding means above and spaced apart from the ground, said support means including (i) a central support structure including first, second, third and fourth unitary hinge members, a first elongate member having a pair of ends, one of said ends being connected to said first hinge member, the other of said ends being connected to said second hinge member, a second elongate member spaced apart from and opposed to said first elongate member and having first and second ends, said first end being connected to said third hinge member, said second end being connected to said fourth hinge member, said first and second elongate members bounding a space intermediate said elongate members, a pliable fabric member slidably connected to said elongate members beneath a portion of said bedding means and extending across said space intermediate said elongate members to support the weight of at least a portion of the individual's body bearing against said fabric member, said fabric member including a first sleeve slidably mounted on said first elongate member and including a second sleeve slidably mounted on said second elongate member, said sleeves being slidably mounted on said first and second elongate members before said one of said ends of said first elongate member is connected to said first hinge member and before said first end of said second elongate member is attached to said third hinge member, said hinge members being sized to prevent said sleeves from being slidably removed from said first and second elongate members, (ii) a pair of ground engaging legs each connected to and extending outwardly away from said central support structure, and (iii) at least one outrigger structure connected to and extending outwardly from said central support structure, said outrigger structure at least partially circumscribing and bounding an open area;

said bedding means including a pliable fabric pocket shaped and dimensioned to slider over said outrigger structure to extend across said open area to support the weight of at least a portion of the individual's body which is bearing against the pocket.

5. The bed of claim 4 including a pliable thermal layer adjacent and beneath said bedding material, said thermal layer insulating against the transfer of heat from the individual's body and extending over said pliable fabric member between said pliable fabric member and said portion of said bedding means into said pliable fabric pocket, said thermal layer being removable from said fabric pocket and from between said bedding material and said pliable fabric member.

6. A bed including (a) bedding means defining a surface for an individual to recline on and including a layer of pliable material, (b) means for supporting said bedding means above and spaced apart from the ground, said support means including (i) a central support structure including first, second, third and fourth unitary hinge members, a first elongate member having a pair of ends, one of said ends being connected to said first hinge member, the other of said ends being connected to said second hinge member, a second elongate member spaced apart from and opposed to said first elongate member and having first and second ends, said first end being connected to said third hinge member, said second end being connected to said fourth hinge member, said first and second elongate members bounding a space intermediate said elongate members, (ii) a pair of ground engaging legs each connected to and extending outwardly away from said central support structure, and (iii) at least one U-shaped outrigger member pivotally connected to and extending outwardly from said first and third hinge members, (iv) a U-shaped tent support member pivotally connected to said first and third hinge members and normally extending upwardly and outwardly from said bedding means and shaped and dimensioned such that said tent support member and said outrigger member can nest one within the other;

(c) a pliable fabric tent structure extending in part over said tent support member above at least a portion of said bedding means.

7. The bed of claim 6 wherein said elongate members, hinge members, tent support member, and outrigger member are shaped and dimensioned such that said outrigger member and said tent support member can be folded adjacent said elongate members in parallel relationship with (a) said elongate member lying in a first plane;

(b) said outrigger member and said tent support member lying nested one in the other in a common second plane parallel to said first plane.

8. The bed of claim 7 including (a) a second U-shaped outrigger member pivotally connected to and extending outwardly from said second and fourth hinge members; and, (b) a second U-shaped tent support member pivotally connected to said second and fourth hinge members and normally extending upwardly and outwardly from said bedding means and shaped and dimensioned such that said second outrigger member and said second tent support member can be folded adjacent said first outrigger member in a third common plane parallel to said first and second planes with said second support member and said second outrigger member nested one in the other.

9. The bed of claim 8 wherein said legs are pivotally connected to said central support structure and can be folded adjacent said first and second elongate members in a fourth common plane parallel to said first plane.

10. The bed of claim 9 wherein (a) said legs are U-shaped; and, (b) one of said legs is pivotally attached to said first and third hinge members; and, (c) the other of said legs is pivotally attached to said second and fourth hinge members.

* * * * *